US010451339B1

(12) United States Patent
Wantland et al.

(10) Patent No.: US 10,451,339 B1
(45) **Date of Patent: *Oct. 22, 2019**

(54) ILLUMINATED ADJUSTABLE DIVIDER FOR A STORAGE BIN OF A REFRIGERATOR APPLIANCE

(71) Applicant: Haier US Appliance Solutions, Inc., Wilmington, DE (US)

(72) Inventors: Louis A. Wantland, Louisville, KY (US); Lauren Nicole Platts, Louisville, KY (US); Bagawathkumar Chellappan, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/013,283

(22) Filed: Jun. 20, 2018

(51) Int. Cl.
*F25D 27/00* (2006.01)
*F25D 25/02* (2006.01)
*F25D 23/06* (2006.01)

(52) U.S. Cl.
CPC ..... *F25D 27/005* (2013.01); *F25D 23/069* (2013.01); *F25D 25/025* (2013.01)

(58) Field of Classification Search
CPC .... F25D 27/005; F25D 27/00; F25D 2327/00; F25D 23/069; F25D 25/025; A47B 88/497; A47B 88/975; A47B 2210/0064; A47B 2210/0083; A47B 2210/175
See application file for complete search history.

(56) References Cited

U.S. PATENT DOCUMENTS 3,506,325 A * 4/1970 Horvay ..... F25D 25/02 312/223.5
6,042,244 A * 3/2000 Witkoski ..... A47F 5/0043 362/125
6,231,205 B1 * 5/2001 Slesinger ..... A47B 96/02 362/125
7,338,180 B2 * 3/2008 Wing ..... F25D 27/00 312/408
8,322,873 B2 * 12/2012 Glovatsky ..... F25D 27/00 362/23.16
8,387,405 B2 3/2013 Johnson
8,764,135 B1 * 7/2014 Huang ..... A47B 88/40 312/331
8,911,042 B2 12/2014 Bassi et al.
9,766,010 B2 9/2017 Katu et al.
(Continued)

FOREIGN PATENT DOCUMENTS

WO WO2018001502 A1 1/2018

*Primary Examiner* — Daniel J Rohrhoff
(74) *Attorney, Agent, or Firm* — Dority & Manning, P.A.

(57) ABSTRACT

A refrigerator appliance includes drawer assembly for a chilled chamber of the appliance. The drawer assembly includes a storage bin positioned within the chilled chamber and one or more adjustable dividers slidably mounted within the storage bin. The adjustable dividers include a top support arm, a window that acts as a light guide or diffuser, and a light source mounted to the adjustable divider for illuminating the storage bin. The drawer assembly further includes a power supply, such as a bus bar assembly having parallel positive and negative strip terminals that remain connected with spring terminals on the adjustable dividers to ensure the light source remains illuminated when the adjustable dividers are moved within the storage bin.

18 Claims, 11 Drawing Sheets

(56) References Cited

U.S. PATENT DOCUMENTS 9,845,986 B2 * 12/2017 Sankhgond ..... F25D 25/025
9,897,372 B2 * 2/2018 Daniel ..... F21V 33/0044
2004/0264160 A1 * 12/2004 Bienick ..... A47B 97/00 362/602
2008/0007945 A1 * 1/2008 Kelly ..... A47F 3/001 362/218
2008/0186696 A1 * 8/2008 Awai ..... F25D 27/005 362/92
2008/0236183 A1 * 10/2008 Iimura ..... F25D 25/02 62/264
2008/0307818 A1 * 12/2008 Min ..... F25D 11/02 62/264
2010/0290251 A1 * 11/2010 Wang ..... H05B 37/02 362/612
2010/0319391 A1 * 12/2010 Lim ..... F25D 25/025 62/441
2013/0099651 A1 * 4/2013 Hwang ..... F25D 25/025 312/404
2014/0152166 A1 * 6/2014 Baum ..... F25D 25/025 312/404
2014/0265802 A1 * 9/2014 Wilcox ..... F25D 25/025 312/404
2014/0312759 A1 * 10/2014 Song ..... F25D 25/025 312/405.1
2014/0320040 A1 * 10/2014 Katu ..... F25D 27/00 315/292
2015/0022072 A1 * 1/2015 Haltmeyer ..... F25D 25/025 312/401
2015/0069066 A1 * 3/2015 Choi ..... F25D 25/022 220/533
2016/0153704 A1 * 6/2016 Burke ..... F25D 25/025 312/404
2016/0282037 A1 * 9/2016 Han ..... F25D 23/00
2018/0149415 A1 * 5/2018 Jo ..... F25D 25/025
2018/0266671 A1 * 9/2018 Hiemstra ..... F21V 33/0012

* cited by examiner

ILLUMINATED ADJUSTABLE DIVIDER FOR A STORAGE BIN OF A REFRIGERATOR APPLIANCE

FIELD OF THE INVENTION

The present subject matter relates generally to refrigerator appliances, and more particularly to adjustable dividers for storage bins of refrigerator appliances.

BACKGROUND OF THE INVENTION

Refrigerator appliances generally include a cabinet that defines a chilled chamber for receipt of food articles for storage. In addition, refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

While food articles or other items may be conveniently stored in storage bins, items located in the bottom of the storage bin may frequently not be visible due to insufficient lighting. In this regard, for example, a light located on a back wall of the chilled chamber may not provide sufficient lighting for ease of viewing items located in storage bins positioned within the chamber. For example, a freezer drawer of a bottom mount refrigerator typically includes a large storage bin that slides out when the drawer is opened. Light generated within the cabinet is often insufficient for illuminating the freezer drawer when opened. Therefore, a user may need to remove and/or rearrange items in a storage bin in order to locate a specific item. These difficulties can lead to consumer frustration and increased time when searching for items located in storage bins.

Accordingly, a refrigerator appliance with features for improved illumination of storage bins within the chilled chambers of the appliance would be useful. More particularly, a storage bin for a refrigerator appliance including adjustable and/or removable dividers having lighting features for improved illumination and visibility would be particularly beneficial.

BRIEF DESCRIPTION OF THE INVENTION

Additional aspects and advantages of the invention will be set forth in part in the following description, or may be apparent from the description, or may be learned through practice of the invention.

In a first exemplary embodiment, a refrigerator appliance defining a vertical direction, a lateral direction, and a transverse direction is provided. The refrigerator appliance includes a cabinet defining a chilled chamber, a door providing selective access to the chilled chamber, and a drawer assembly. The drawer assembly includes a storage bin positioned within the chilled chamber and an adjustable divider positioned within the storage bin. A light source is mounted on the adjustable divider and a power supply assembly is electrically connected to the light source as the adjustable divider slides within the storage bin.

According to another exemplary embodiment, a drawer assembly for an appliance is provided. The appliance includes a cabinet defining a chamber. The drawer assembly includes a storage bin positioned within the chamber and an adjustable divider positioned within the storage bin. A light source is mounted on the adjustable divider and a bus bar assembly includes a negative strip terminal that extends along a lateral direction parallel to a positive strip terminal, the negative strip terminal and the positive strip terminal being electrically connected to the light source as the adjustable divider slides within the storage bin.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
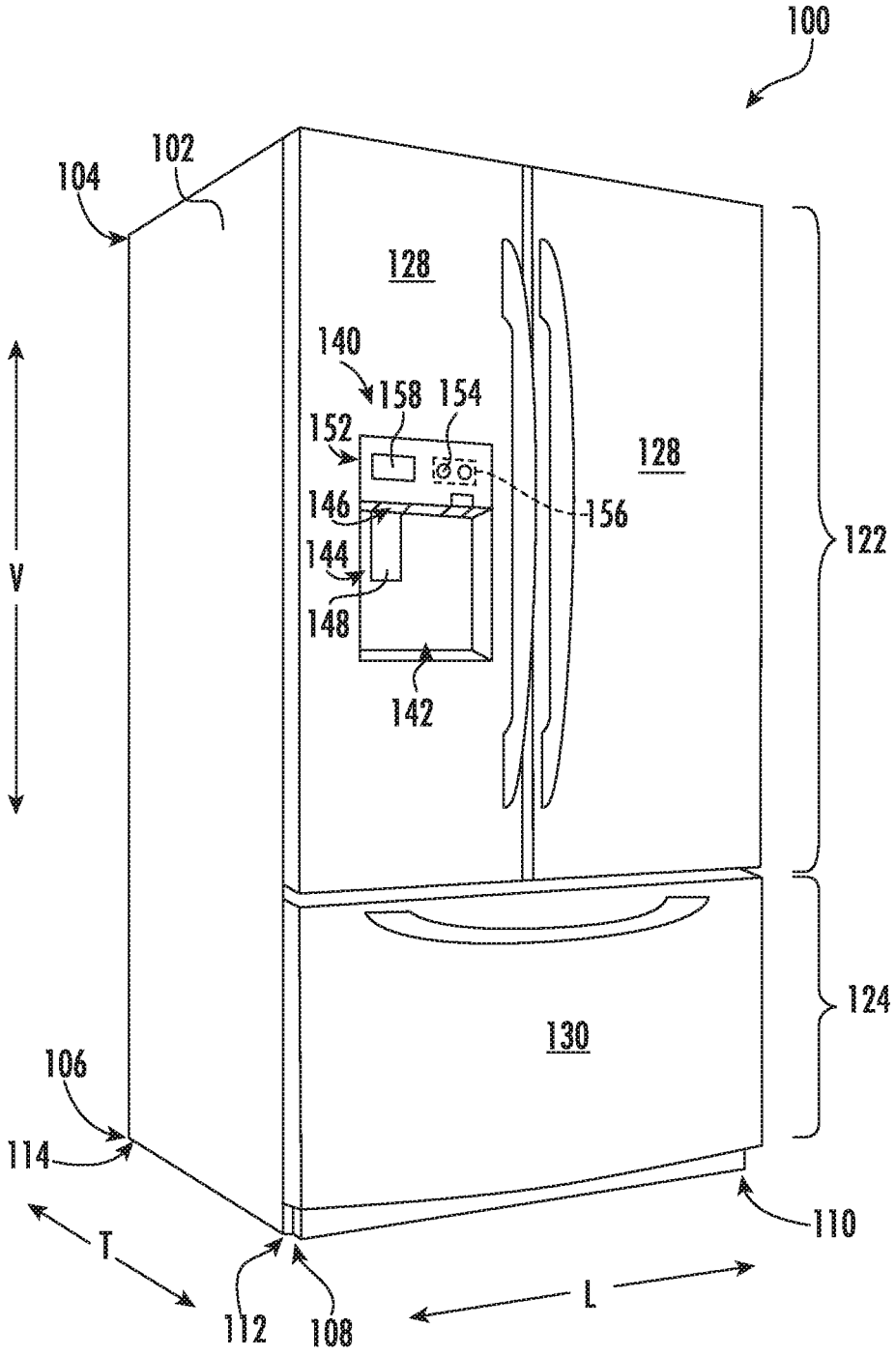
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
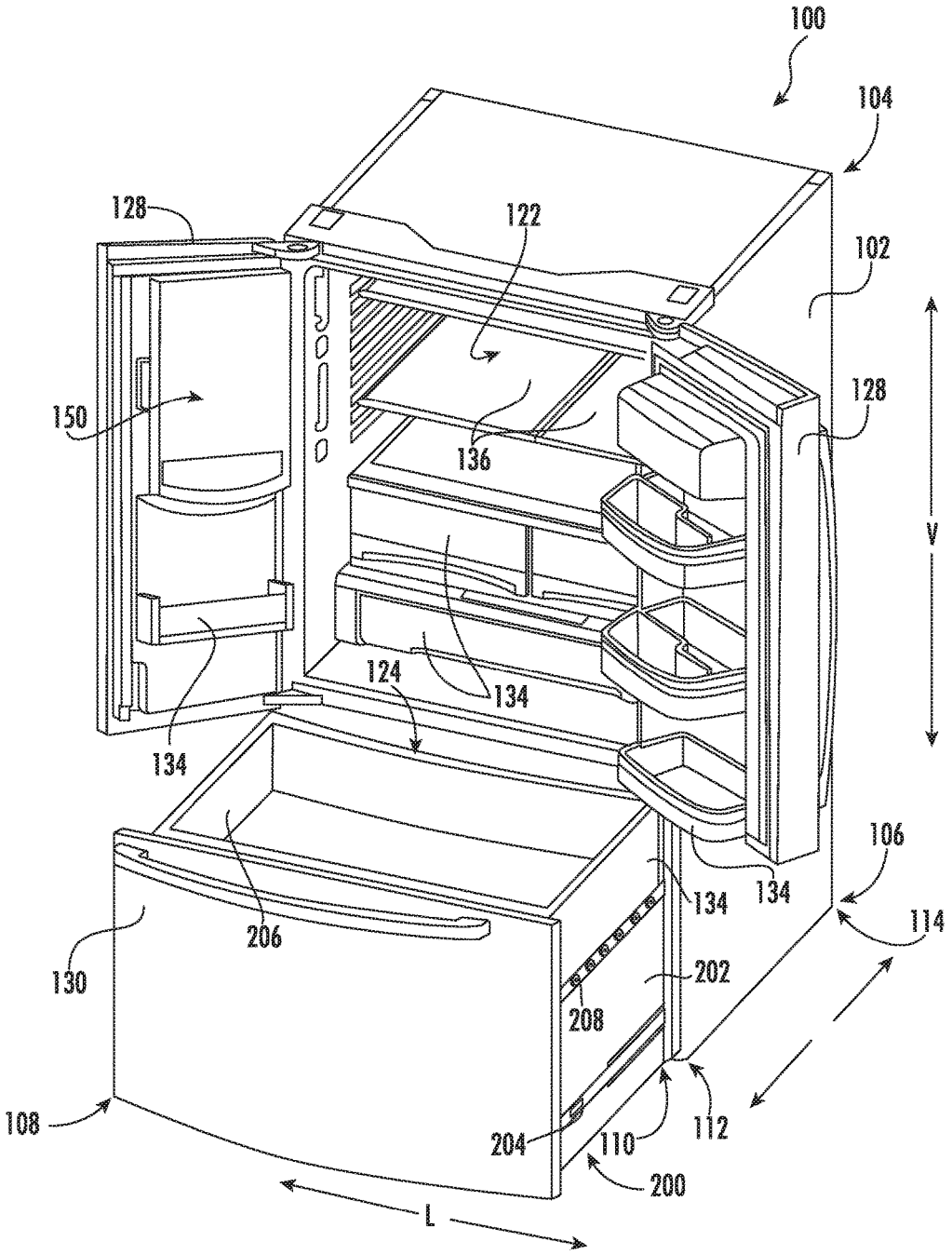
FIG. 2 provides a perspective view of the exemplary refrigerator appliance of FIG. 1, with the doors shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring again to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142. By contrast, refrigerator door 128 may define an icebox compartment 150 (FIG. 2) housing an icemaker and an ice storage bin (not shown) that are configured to supply ice to dispenser recess 142.

A control panel 152 is provided for controlling the mode of operation. For example, control panel 152 includes one or more selector inputs 154, such as knobs, buttons, touch-screen interfaces, etc., such as a water dispensing button and an ice-dispensing button, for selecting a desired mode of operation such as crushed or non-crushed ice. In addition, inputs 154 may be used to specify a fill volume or method of operating dispensing assembly 140. In this regard, inputs 154 may be in communication with a processing device or controller 156. Signals generated in controller 156 operate refrigerator appliance 100 and dispensing assembly 140 in response to selector inputs 154. Additionally, a display 158, such as an indicator light or a screen, may be provided on control panel 152. Display 158 may be in communication with controller 156, and may display information in response to signals from controller 156.

As used herein, "processing device" or "controller" may refer to one or more microprocessors or semiconductor devices and is not restricted necessarily to a single element. The processing device can be programmed to operate dispensing assembly 140 and other systems of refrigerator appliance 100. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring now to FIG. 2, a drawer assembly 200 which may be used with refrigerator appliance 100 will be described according to an exemplary embodiment of the present subject matter. According to the illustrated embodiment, drawer assembly 200 is positioned or mounted within freezer chamber 124 of refrigerator appliance 100. However, it should be appreciated that according to alternative embodiments, aspects of drawer assembly 200 may be applied to any suitable storage bin within any suitable refrigerator appliance. For example, aspects of the present subject matter may be applied to one or more of bins 134 within fresh food chamber 122 of refrigerator appliance 100. Alternatively, drawer assembly 200 or variations thereof may be incorporated into a pan in fresh food chamber 122, in a standalone convertible drawer, etc.

As best shown in FIG. 2, drawer assembly 200 includes a storage bin 202 that is supported by a pair of drawer slides 204. More specifically, drawer slides 204 are mounted to cabinet 102 within freezer chamber 124 and slidably couple freezer door 130 to cabinet 102 to provide selective access to freezer chamber 124. Storage bin 202 is mounted either directly or indirectly to drawer slides 204 which provide vertical support to storage bin 202. In addition, an auxiliary sliding bin 206 may be positioned on top of storage bin 202 and may include a plurality of wheels 208 that permit auxiliary sliding bin 206 to roll into and out of freezer chamber 124 independently of storage bin 202, e.g., either on top of storage bin 202 or on support ledges or shelves defined within or mounted to cabinet 102 within freezer chamber 124. Although aspects of the present subject matter are described below in relation to storage bin 202, it should be appreciated that the present disclosure is also applicable to auxiliary sliding bin 206 and/or bins 134.

Figure 3:
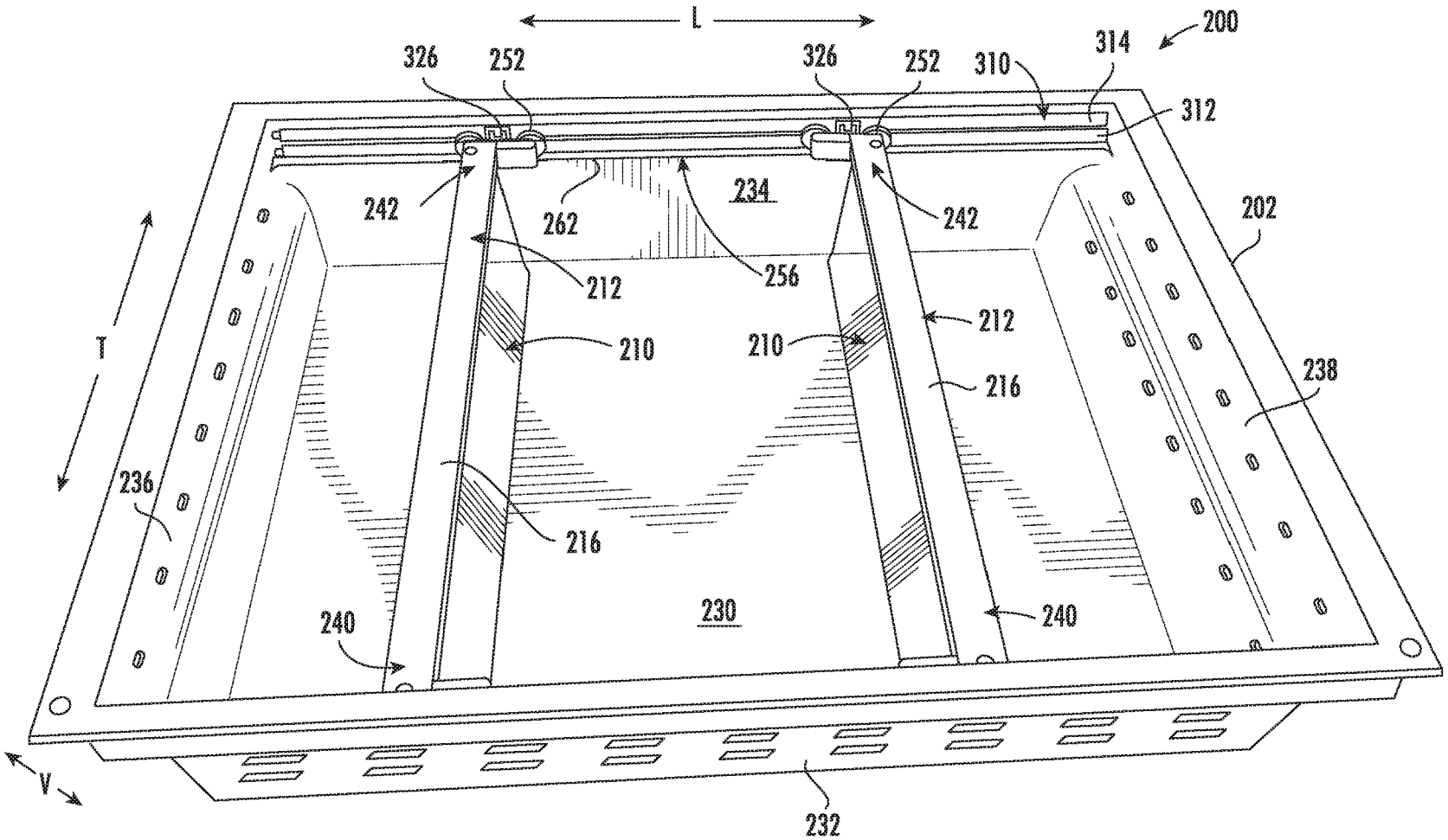
FIG. 3 provides a perspective view of a storage bin for use with the exemplary refrigerator appliance of FIG. 1 according to an exemplary embodiment of the present subject matter.

Referring now to FIG. 3, drawer assembly 200 will be described according to an exemplary embodiment. As shown, storage bin 202 may generally define a vertical direction V, a lateral direction L, and the transverse direction T which correspond to the same directions defined by refrigerator appliance 100. As shown drawer assembly 200 includes one or more adjustable dividers 210 which are positioned within storage bin 202. According to the illustrated, drawer assembly 200 includes two adjustable dividers 210 that are removably mounted within storage bin 202 and which may be independently movable along the lateral direction L. In addition, adjustable dividers 210 are illustrated as extending substantially within a plane defined by the transverse direction T in the vertical direction V. However, it should be appreciated that drawer assembly 200 may include any suitable number of adjustable dividers 210 which may slide along any suitable direction and may include other configurations, e.g., such as laterally extending arms or additional dividers.

Figure 4:
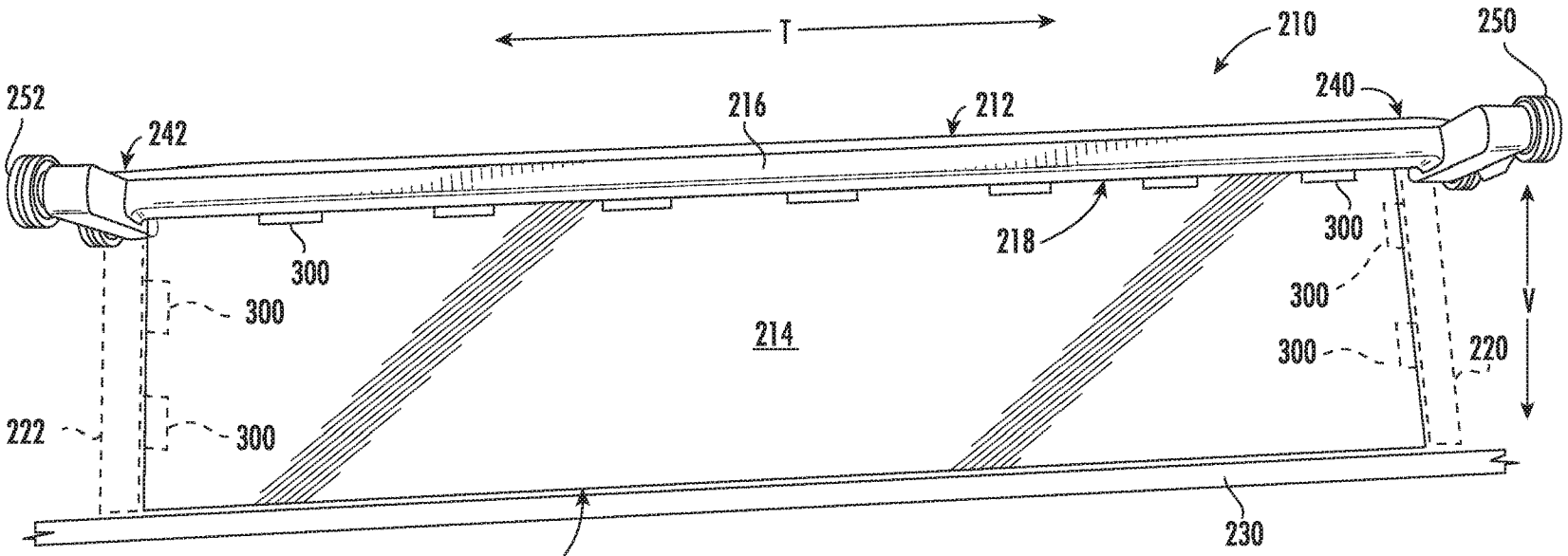
FIG. 4 provides a perspective view of an adjustable divider for use with the exemplary storage bin of FIG. 3 according to another exemplary embodiment of the present subject matter.
Figure 5:
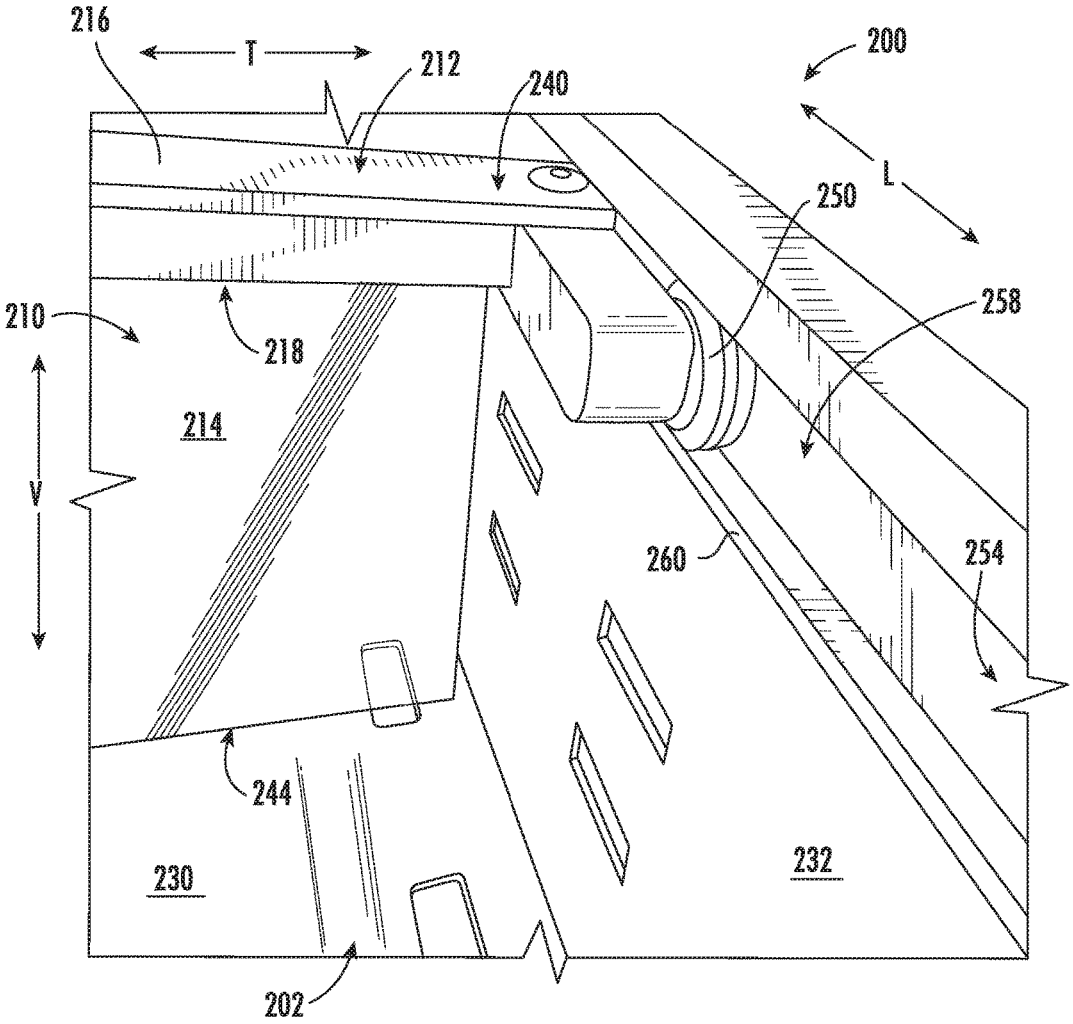
FIG. 5 provides a close-up view of a roller of the exemplary adjustable divider mounted to the exemplary storage bin of FIG. 3.

Referring now also to FIGS. 4 and 5, adjustable dividers 210 will be described in more detail. As shown, each adjustable provider 210 generally includes a support structure 212 and a window 214 mounted to support structure 212. In this regard, support structure 212 may generally include a top support arm 216 which extends along the transverse direction T within storage bin 202. Top support arm 216 may have an underside 218 to which window 214 is attached. In addition, according to an alternative embodiment (and as indicated by dotted lines in FIG. 4), support structure 212 may include a front support 220 and a rear support 222 which extend along the vertical direction V on opposite sides of window 214 along the transverse direction T.

Referring now generally to FIGS. 3 through 6, storage bin 202 may be configured for slidably supporting each adjustable divider 210. In this regard, for example, storage bin 202 generally includes a bottom wall 230 which extends substantially in a horizontal plane (e.g., as defined by the lateral direction L and the transverse direction T). In addition, bottom wall 230 extends along the transverse direction T between a front wall 232 and a rear wall 234 of storage bin 202 and along the lateral direction L between a first side wall 236 and a second side wall 238 of storage bin 202. According to the illustrated embodiment front wall 232, rear wall 234, first side wall 236, and second side wall 238 all extend substantially along the vertical direction V in define a receiving space or volume of storage bin 202. It should be appreciated that as used herein, terms of approximation, such as "approximately," "substantially," or "about," refer to being within a ten percent margin of error.

As illustrated, top support arm 216 extends along the transverse direction T between a front end 240 which is slidably mounted on front wall 232 of storage bin 202 and a rear end 242 which is slidably mounted on rear wall 234 of storage bin 202. In this manner, the weight of adjustable divider 210 is supported by front wall 232 and a rear wall 234 of storage bin 202, such that window 214 does not need to be supported by bottom wall 230 of storage bin 202. In this manner, adjustable divider 210 may be more easily moved or slid by a user of refrigerator appliance 100 along the lateral direction L. Indeed, as best shown in FIG. 4, a bottom end 244 of window 214 may be suspended above bottom wall 230 such that it does not contact bottom wall 230 (i.e., a gap is defined therebetween).

According to various exemplary embodiments of the present subject matter, adjustable divider 210 may be slidably mounted on storage bin 202 using rollers, a slide assembly or mechanism, or any other suitable low friction interface. For example, according to the illustrated embodiment, top support arm 216 generally includes one or more front rollers 250 and rear rollers 252 which are rotatably mounted to front end 240 and rear end 242 of top support arm 216, respectively. In addition, front wall 232 of storage bin 202 includes a front guide track 254 and rear wall 234 of storage bin 202 defines a rear guide track 256, both of which extend substantially along the lateral direction L. Front guide track 254 and rear guide track 256 provide vertical support to top support arm 216 and are configured for slidably receiving front end 240 and rear end 242, respectively, of top support arm 216.

More specifically, according to the illustrated embodiment, for each adjustable divider, front end 240 includes two laterally spaced front rollers 250 and rear end 242 includes two laterally spaced rear rollers 252. These rollers 250, 252 are received in their respective guide tracks 252, 254 to provide vertical support while permitting adjustable divider 210 to move within storage bin 202. According to the embodiment illustrated in FIG. 5, front guide track 254 includes a U-shaped recess 258 and a retaining flange 260, both defined by front wall 232 for receiving front rollers 250 and preventing them from falling out of front guide track 254. By contrast, according to the illustrated embodiment, rear guide track 256 includes a ledge 262 which extends into the receiving space of storage bin 202 from a rear wall 234 and provides a surface for rear rollers 252 to roll along.

It should be appreciated that front guide track 254 and rear guide track 256 may vary according to alternative embodiments while remaining within scope of the present subject matter. For example, referring briefly to FIG. 7, front guide track 254 could alternatively include a laterally extending rib 264 that extends along a top of front wall 232 along the lateral direction L. In addition, front rollers 250 could define a groove 266 for receiving the laterally extending rib 264. In this regard, for example, lateral rib 264 may protrude from front wall 232 upward along the vertical direction and form an inverted V. Groove 266 may also have a recess shaped as an inverted V for slidably mounting on laterally extending rib 264. Other embodiments and configurations for supporting top support arm 216 of adjustable divider 210 are possible and within the scope of the present subject matter.

Figure 7:
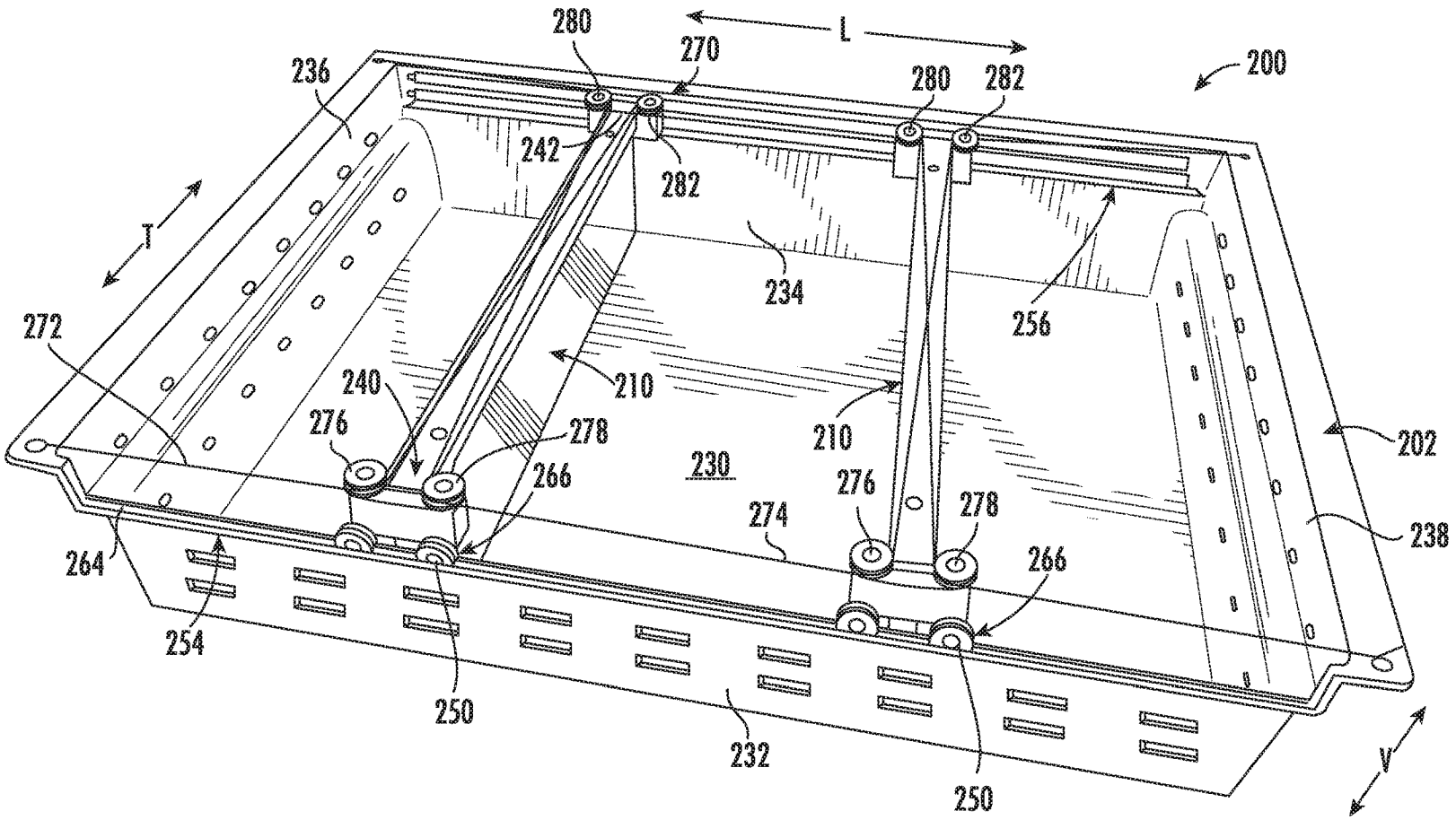
FIG. 7 provides a perspective view of a storage bin including double cable system anti-racking features for use with the exemplary refrigerator appliance of FIG. 1 according to another exemplary embodiment of the present subject matter.

Referring still briefly to FIG. 7, drawer assembly 200 may include one or more anti-racking features which generally prevent adjustable dividers 210 from binding within front guide track 254 and rear guide track 256, e.g. such as when front end 240 and rear end 242 fall out of alignment along the transverse direction T. Racking can cause adjustable dividers 210 to bind within storage bin 202 such that they are either very difficult to move or will not move at all. As will described briefly herein according to exemplary embodiments, the anti-racking features may include a double cable system, single cable systems, guided channels providing little or no "play" with seated rollers, or a rack and pinion system.

For example, as illustrated, drawer assembly 200 may include a double cable assembly 270 which generally comprises two cables passed between rollers mounted on adjustable dividers 210 in a manner that substantially equalized forces acting on front end 240 and second end 242 of adjustable divider 210 during movement. Specifically, as illustrated, double cable assembly 270 includes a first cable 272 and a second cable 274. In addition, each adjustable divider 210 may include a first pulley 276 and a second pulley 278 mounted on front end 240 of top support arm 216 and a third pulley 280 and a fourth pulley 282 mounted on rear end 242 of top support arm 216.

First cable 272 may be fixedly attached to a corner where front wall 232 and first side wall 236 meet, may wrap around first pulley 276, then around fourth pulley 282. If more than one adjustable divider 210 is used, first cable 272 may then pass around third pulley 280, then second pulley 278, before being fixedly attached to another corner where front wall 232 and a second side wall 238 meet. Similarly, second cable 274 may be fixedly attached to a corner where rear wall 234 and first side wall 236 meet, may wrap around third pulley 280, then around second pulley 278. If more than one adjustable divider 210 is used, second cable 274 may then pass around first pulley 276, then fourth pulley 282, before being fixedly attached to another corner where rear wall 234 and a second side wall 238 meet. Pulleys 276-282 are rotatably mounted about a vertical axis V on top support arm 216 such that first cable 272 and second cable 274 may pass easily over the pulleys.

In this manner, double cable system 270 generally assists with synchronizing motion of front ends 240 and rear ends 242 of adjustable dividers 210, e.g., such that they translate along the lateral direction L at a common speed. Thus, a user may push on any location on adjustable divider 210, yet an off-center application of force, which might otherwise urge the adjustable divider 210 to "rack" or bind, is avoided. In particular, for example, as front end 240 of adjustable divider 210 moves towards second side wall 238, first pulley 276 may push against first cable 272 such that first cable 272 goes in tension and pulls fourth pulley 282 toward second side wall 238. Simultaneously, second cable 274 goes in tension, similarly urging front end 240 and rear end 242 of adjustable divider 210 toward second sidewall 238. Thus, with little slack in first cable 272 and second cable 274, the lengths of these cables from side walls 236, 238 to adjustable dividers 210 are relatively constant, thereby keeping adjustable divider 210 extending substantially along the transverse direction T.

According to an exemplary embodiment, double cable system 270 may also be used to power light sources 300. In this regard, for example, first cable 272 may be electrically connected to a positive power terminal of power supply assembly 302 and second cable 274 may be electrically connected to a negative power terminal of power supply assembly 302. Front rollers 250 and rear rollers 252 may be constructed from a conductive material or otherwise contain an electrical contact for electrically coupling to the energized cables 272, 274. According to such embodiment, areas where first cable 272 and second cable 274 cross or are otherwise likely to contact each other, insulation may be positioned to prevent such contact and electrical shorting.

Figure 8:
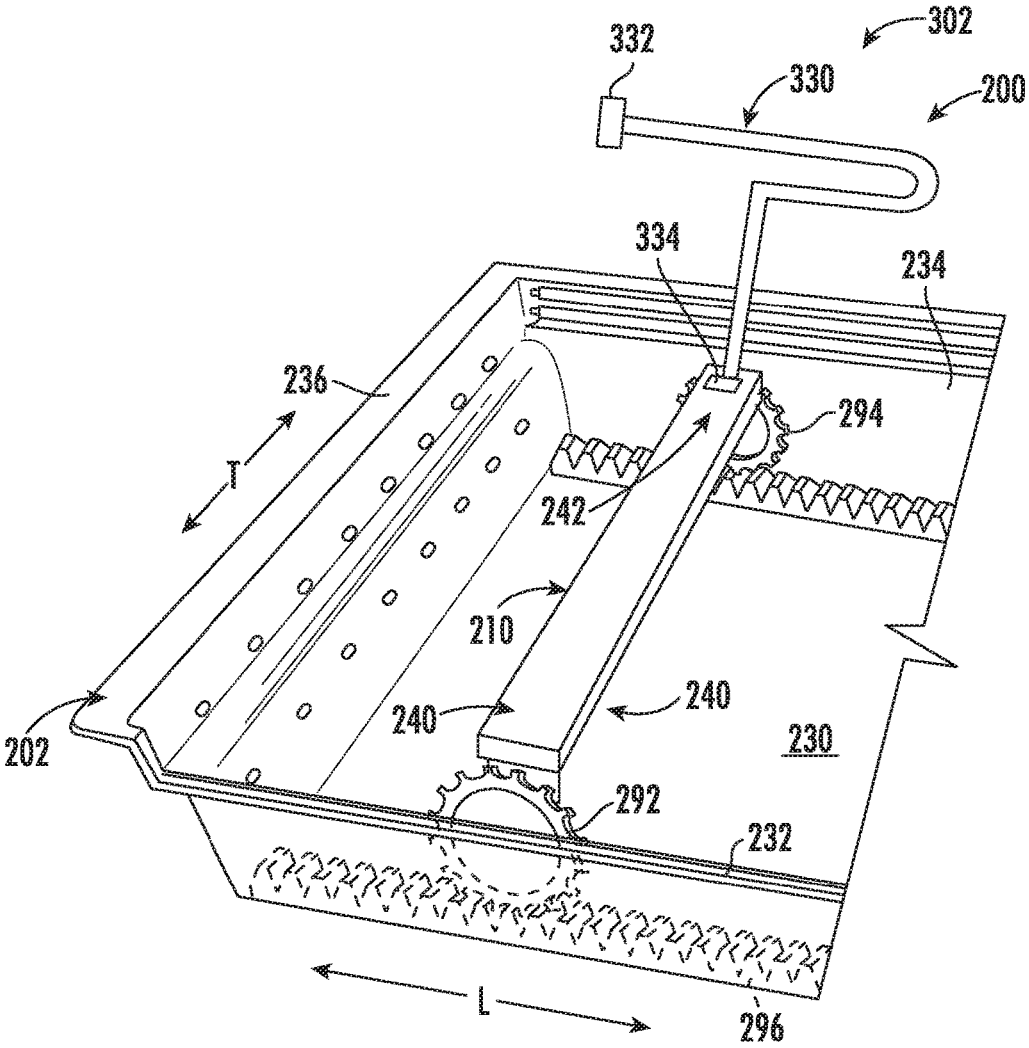
FIG. 8 provides a schematic view of a storage bin including rack and pinion anti-racking features for use with the exemplary refrigerator appliance of FIG. 1 according to another exemplary embodiment of the present subject matter.

According to another exemplary embodiment illustrated in FIG. 8, in order to synchronize the movement of front end 240 and rear end 242 of top support arm 216, drawer assembly 200 may include a rack and pinion system 290. In this regard, a front pinion 292 is rotatably mounted on front end 240 and a rear pinion 294 is rotatably mounted on rear end 242 of top support arm 216. Front guide track 254 and rear guide track 256 may each define a stationary geared rack 296 which is configured for engaging front pinion 292 and rear pinion 294, respectively. In this manner, the movement of front end 240 and rear end 242 is synchronized to minimize or eliminate racking of adjustable divider 210. Thus, any off-center pulling/pushing force on adjustable divider 210 is compensated for through the rack and pinion system 290.

Referring again generally to FIG. 4, and adjustable divider 210 may further include a light source 300 which is mounted to adjustable divider 210 and is generally configured for generating light for any suitable purpose within refrigerator appliance 100. For example, light source 300 may be configured for generating visible light for illuminating portions of storage bin 202. In this regard, light source 300 may include at least one light emitting diode (LED), configured for illuminating as a single color, or may include any other suitable traditional light bulbs or sources, such as halogen bulbs, incandescent bulbs, glow bars, a fiber light source, etc. As another example, light source 300 may include more than one LED and may be capable of illuminating in different colors based on one or more operating conditions of refrigerator appliance 100.

According to still another embodiment, light source 300 may include an ultraviolet (UV) light source for generating UV light for reducing or eliminating mold, bacteria, etc. In this regard, light source 300 may be configured to operate a UV light when sanitation or cleaning of storage bin 202 is desired. For example, light source 300 may activate a UV light intermittently when door is closed to periodically sanitize storage bin 202. In addition, light source 300 may be configured to vary the colors of LEDs or alternate the energized colored bulbs to create visible effects associated with particular operating conditions, such as chamber temperatures, or to display product logos or trademarks. In addition, for example, light sources 300 may be selectively colored to display information such as chamber temperature settings, an indication that one or more food items are out of date, or an indication of what food is stored in a particular area (e.g., green for vegetables, red for meat, etc.). Light source 300 may also be configured for simulating natural light, e.g., to improve food preservation.

According to exemplary embodiments, light source 300 is mounted onto support structure 212 and is configured for directing light through window 214. In this regard, window 214 may be a transparent, translucent, or semi-transparent pane of glass, acrylic, plastic, or other suitable material. Window 214 is generally used as a light guide or light diffuser for transmitting, projecting, and/or diffusing light generated by light source 300. According to still other embodiments, light source 300 need not be mounted directly to support structure 212, but may instead be mounted elsewhere within drawer assembly 200, but being configured for using window 214 as a light guide for directing light.

As illustrated in FIG. 4, light sources 300 may be mounted to the underside 218 of top support arm 216. In addition, light sources 300 may be directed downward along the vertical direction V through window 214 such that a majority of the generated light is directed down on to the bottom wall 230 of storage bin 202. In addition, according to an exemplary embodiment, a bottom wall 230 of storage bin 202 may be coated in a reflective material which is intended to reflect, scatter, or otherwise disperse the light generated by light source 300. In addition, adjustable divider 210 may include light sources 300 mounted on front support 220 and/or rear support 222 (as shown in dotted lines on FIG. 4). These light sources 300 may be used in conjunction with or as an alternative to light sources 300 on top support arm 216 and may generally direct light along the transverse direction T. In this manner, light sources 300 may generally be used too brightly illuminate all portions of storage bin 202 for improved visibility, particularly proximate a bottom wall 230 where cabinet light is typically blocked.

Referring now generally to FIGS. 6 and 9 through 11, drawer assembly 200 further includes a power supply assembly 302 that is electrically connected to light sources 300 on adjustable divider 210 as adjustable divider 210 slides within storage bin 202. In this manner, light sources 300 may remain illuminated regardless of the position of each adjustable divider 210 and a first divider may remain illuminated even if a second divider is removed from power supply assembly 302. Although the figures and description herein describe one exemplary means for powering light sources 300, it should be appreciated that light sources 300 may be powered in any other suitable manner while remaining within the scope of the present subject matter.

Figure 6:
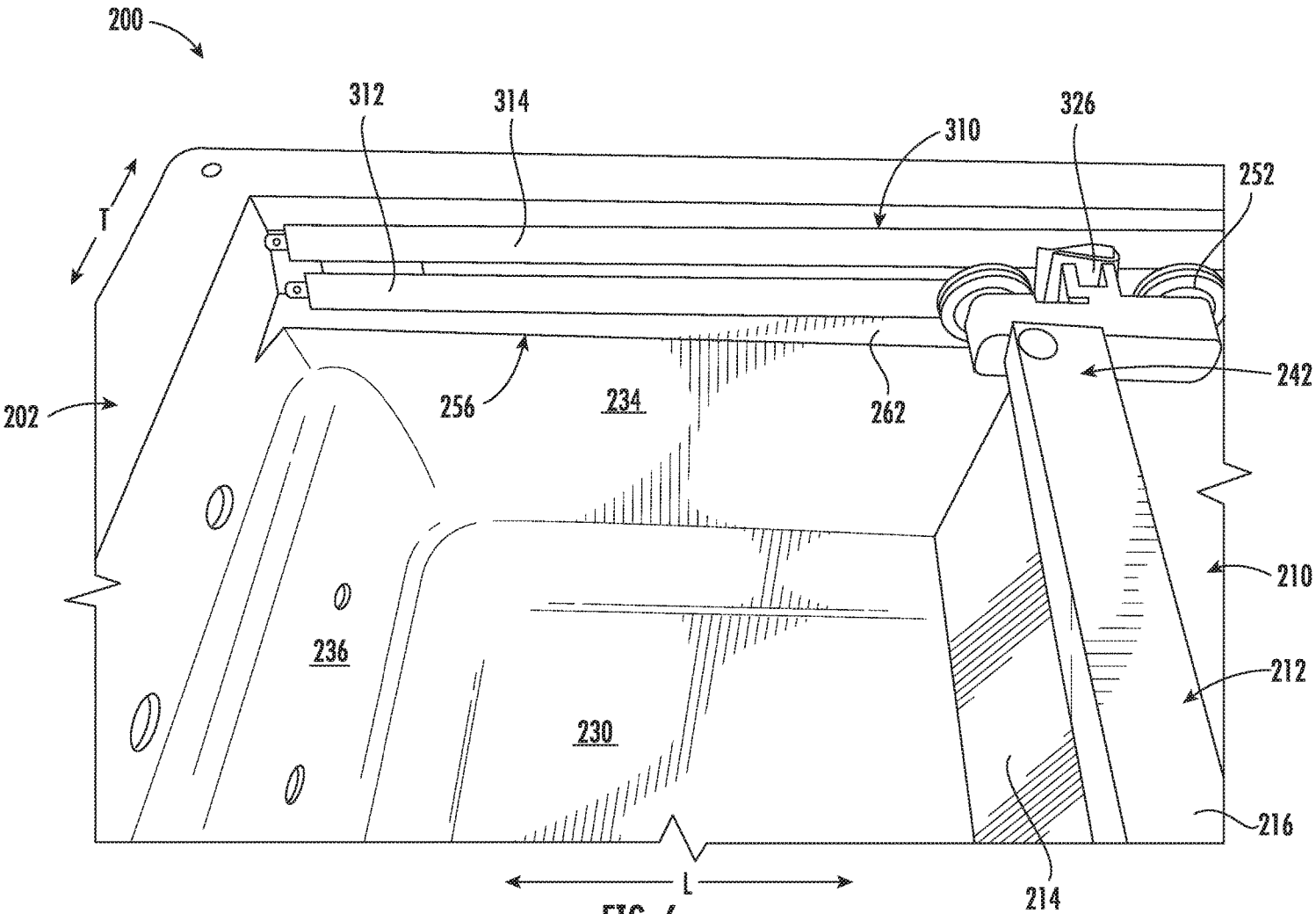
FIG. 6 provides a perspective view of power supply tracks of the exemplary storage bin of FIG. 3.

As illustrated, according to one exemplary embodiment, power supply assembly 302 includes a bus bar assembly 310 which includes at least one negative strip terminal 312 and at least one positive strip terminal 314. Strip terminals 312 and 314 are generally elongated pieces of conductive material that are electrically connected with a negative terminal and a positive terminal of power supply assembly 302, respectively. As best illustrated in FIG. 6, negative strip terminal 312 and positive strip terminal 314 extend substantially along the lateral direction L and are parallel to each other. It should be appreciated that according to alternative embodiments, strip terminals 312, 314 may extend along any other suitable side of storage bin 202 and may be shaped or sized than any other suitable manner.

Figure 9:
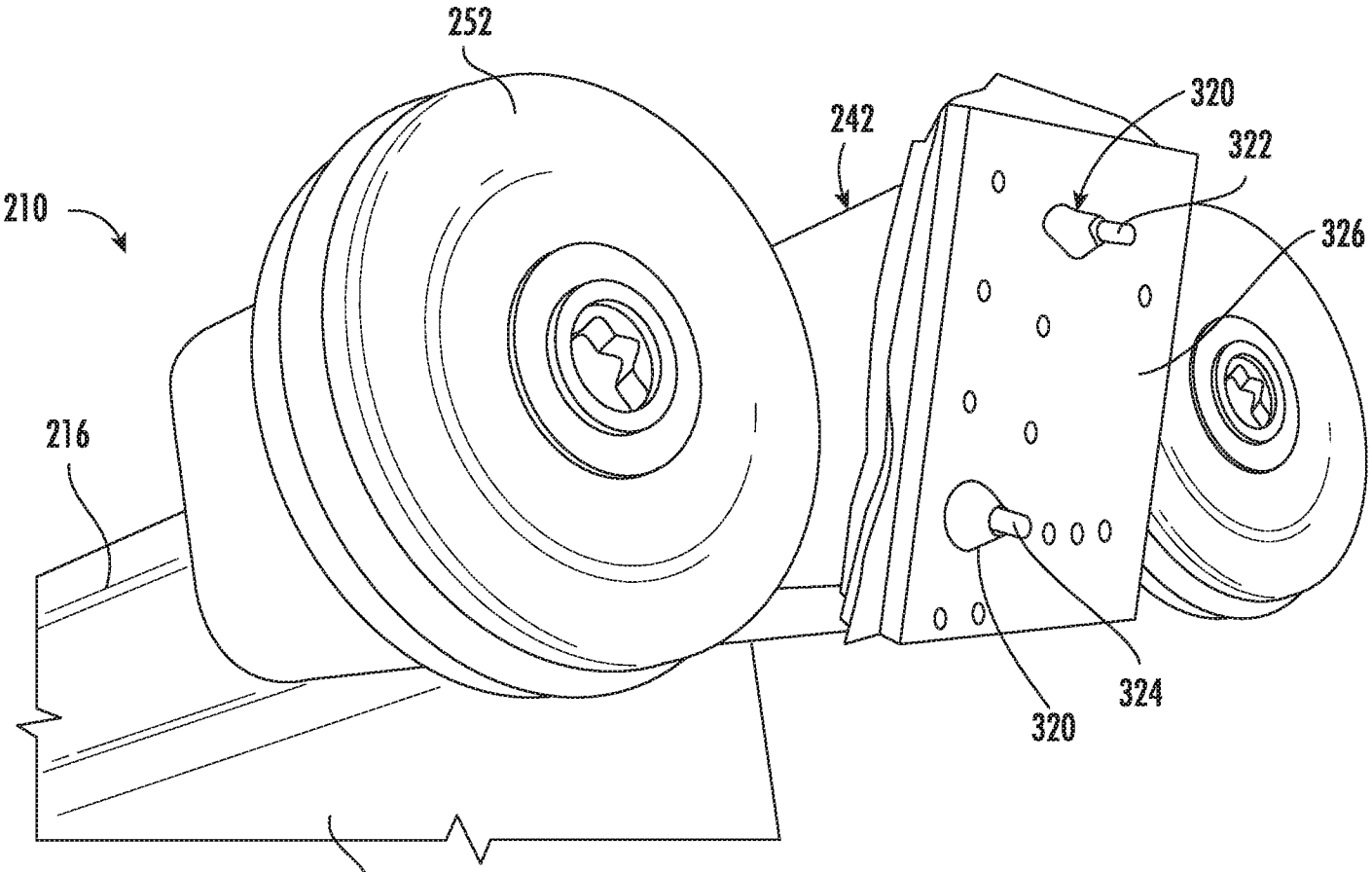
FIG. 9 provides a close-up perspective view of the rollers and contact board of the exemplary adjustable divider of FIG. 4.

Referring now to FIG. 9, adjustable divider 210 may include one or more spring pin connectors 320 which are used to electrically connect light sources 300 to bus bar assembly 310. In this regard, for example, spring pin connectors 320 may include a positive pin 322 in the negative pin 324 which are spring-loaded and configured for engaging positive strip terminal 314 and negative strip terminal 312, respectively, when adjustable divider 210 is positioned within storage bin 202. In addition, according to the illustrated embodiment, spring pin connectors 320 may be mounted on a printed circuit board 326 which may include control electronics for powering some or all of light sources 300 depending on the current operating condition of refrigerator appliance 100.

Although bus bar assembly 310 is described above as providing power to light sources 300, it should be appreciated that according to alternative embodiments, any other suitable method of providing power can be used. For example, each light source 300 may be electrically coupled with dedicated power supply wires. Alternatively, as shown for example in FIG. 8, power supply assembly 302 may include a loop harness 330 that extends between a fixed power supply point 332 on cabinet 102 and an electrical contact 334 on adjustable divider 210.

Figure 10:
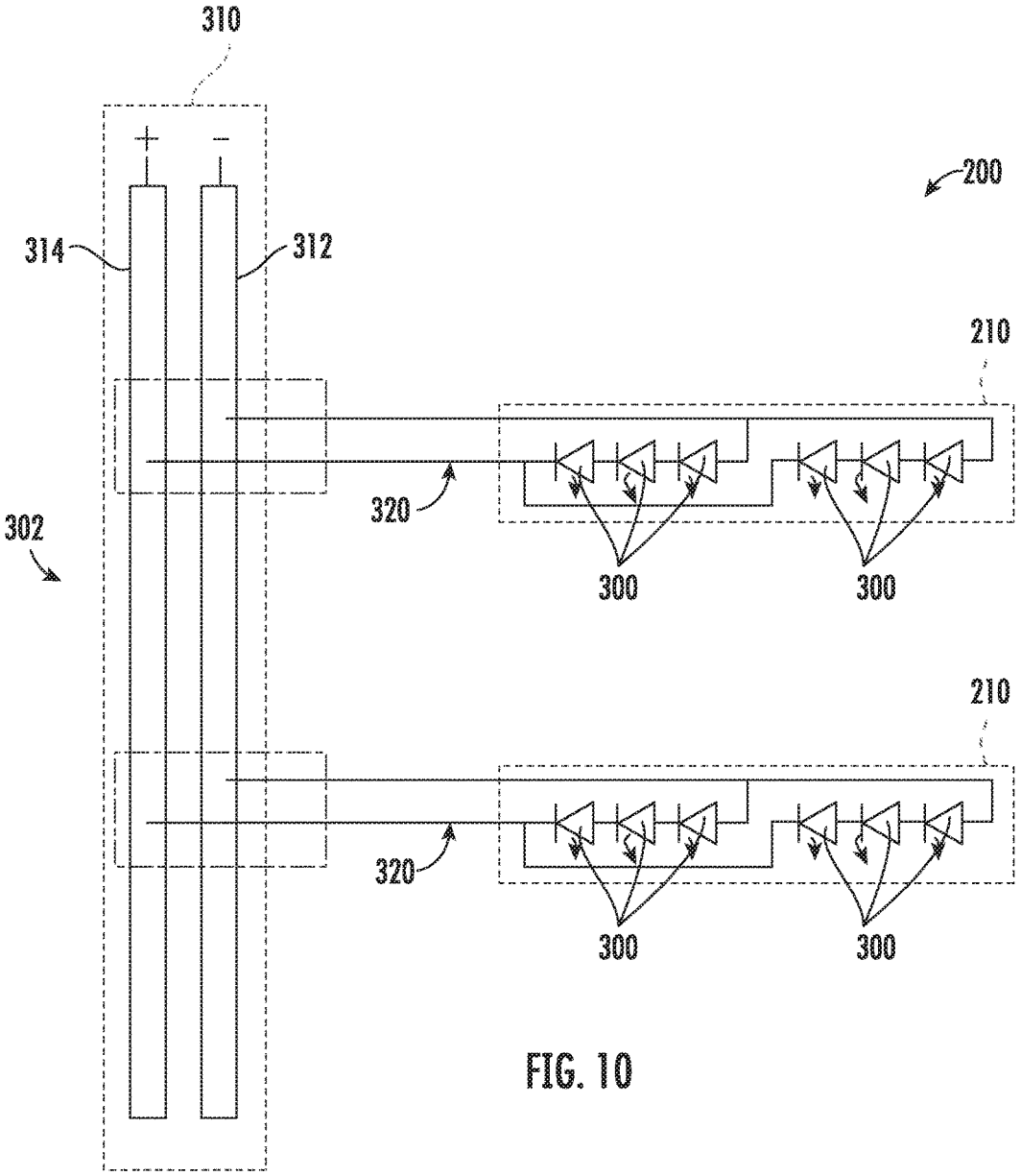
FIG. 10 provides a schematic electrical diagram of the exemplary adjustable divider of FIG. 3 according to an exemplary embodiment of the present subject matter.
Figure 11:
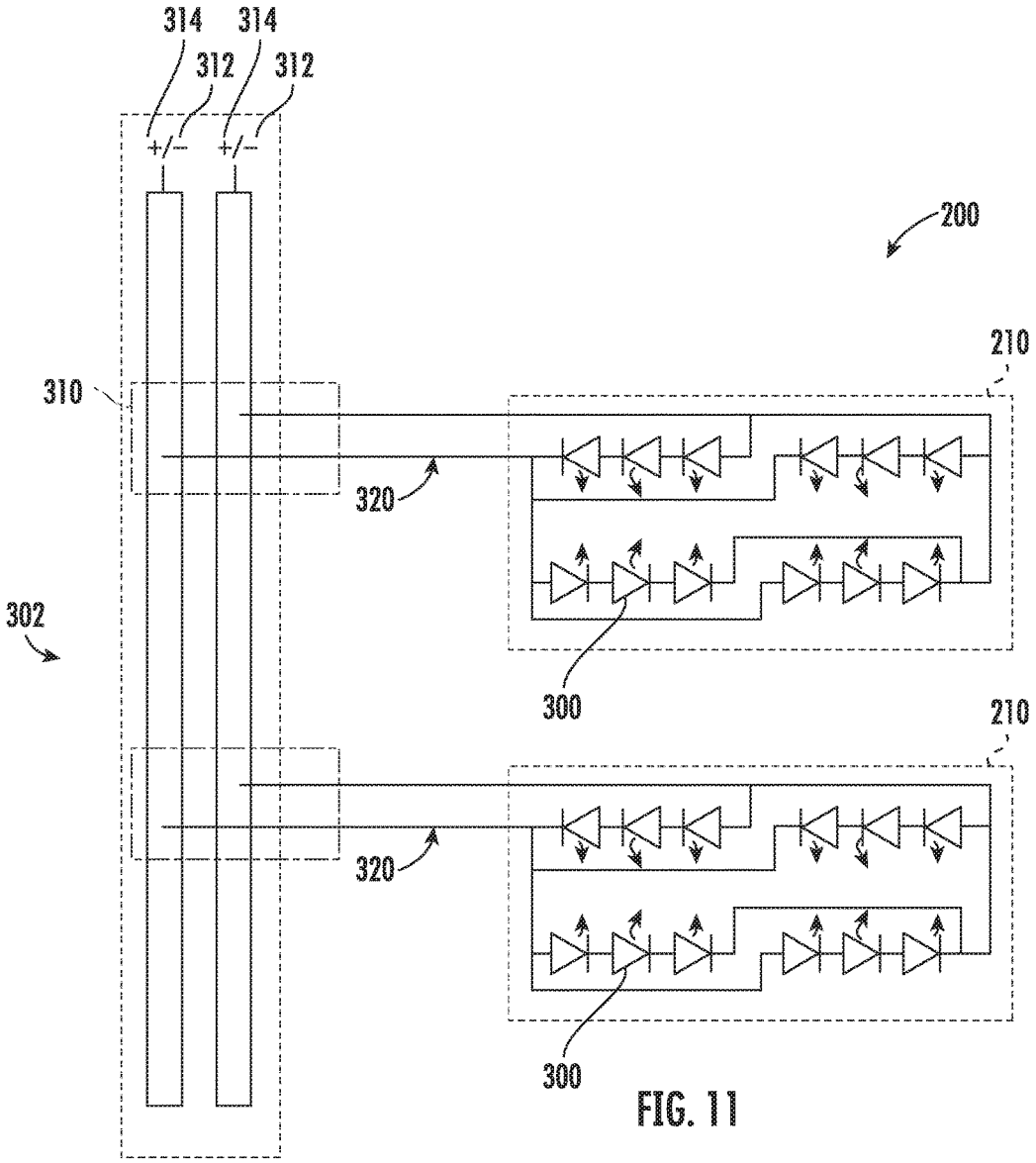
FIG. 11 provides a schematic electrical diagram of the exemplary adjustable divider of FIG. 3 according to another exemplary embodiment of the present subject matter.

Referring now briefly to FIGS. 10 and 11, exemplary wiring diagrams of drawer assembly 200 will be described according to an exemplary embodiment of the present subject matter. Specifically, as shown, bus bar assembly 310 may include negative strip terminal 312 and positive strip terminal 314 which are electrically coupled with light sources 300 on adjustable divider 210. In this manner, as shown in FIG. 10, when power is supplied to bus bar assembly 310, light sources 300 are illuminated simultaneously. In addition, as illustrated, each of the adjustable dividers 210 is electrically connected in parallel to bus bar assembly 310 such that power is provided to each adjustable divider 210 that is connected regardless of whether any other adjustable divider 210 is disengaged from bus bar assembly 310.

By contrast, as illustrated in FIG. 11, bus bar assembly 310 may be configured for switching the polarity of negative strip terminal 312 and positive strip terminal 314 in order to achieve different illumination effects of light sources 300. According to still other embodiments, bus bar assembly 310 may include a plurality of positive strip terminals 314 that all extend parallel to a single, negative strip terminal 312. Each of the plurality of positive strip terminals 314 may be electrically coupled with a subset of light sources 300. In this manner, by selectively energizing positive strip terminals 314, different and unique lighting configurations may be achieved.

As one skilled in the art will appreciate, the above described embodiments are used only for the purpose of explanation. Modifications and variations may be applied, other configurations may be used, and the resulting configurations may remain within the scope of the invention. For example, the configuration of adjustable divider 210 may vary, power may be provided using a different power supply assembly, and other control methods for regulating light operation may be used. One skilled in the art will appreciate that such modification and variations may remain within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a cabinet defining a chilled chamber;

a door providing selective access to the chilled chamber;

a drawer assembly comprising:

a storage bin positioned within the chilled chamber;

an adjustable divider positioned within the storage bin;

a light source mounted on the adjustable divider; and a power supply assembly electrically connected to the light source as the adjustable divider slides within the storage bin, wherein the power supply assembly comprises a bus bar assembly comprising at least one negative strip terminal and at least one positive strip terminal, the positive strip terminal extending substantially along the lateral direction and substantially parallel to the negative strip terminal of the bus bar assembly.

2. The refrigerator appliance of claim 1, wherein the adjustable divider comprises:

a support structure; and a window mounted to the support structure for transmitting, projecting, or diffusing light generated by the light source.

3. The refrigerator appliance of claim 2, wherein the window is transparent or translucent.

4. The refrigerator appliance of claim 2, wherein the light source is mounted onto the support structure.

5. The refrigerator appliance of claim 2, wherein the support structure comprises:

a front support and a rear support positioned on opposite sides of the window along the transverse direction, the light source being mounted to at least one of the front support and the rear support and being directed along the transverse direction.

6. The refrigerator appliance of claim 2, wherein the support structure comprises:

a top support arm that extends along the transverse direction, the light source being mounted to an underside of the top support arm and being directed downward along the vertical direction.

7. The refrigerator appliance of claim 1, wherein a bottom wall of the storage bin is coated in a reflective material.

8. The refrigerator appliance of claim 1, wherein the light source comprises a light emitting diode.

9. The refrigerator appliance of claim 1, wherein the light source comprises at least one ultraviolet light source.

10. The refrigerator appliance of claim 9, wherein the ultraviolet light source is configured to operate when the door is closed.

11. The refrigerator appliance of claim 1, wherein the light source may illuminate in different colors or may include multiple light sources for generating different colors.

12. The refrigerator appliance of claim 1, comprising:

at least two adjustable dividers mounted within the storage bin and being independently, movable along the lateral direction, wherein each of the adjustable dividers is electrically connected in parallel to the bus bar assembly when installed such that power is provided to each adjustable divider connected irrespective of whether any other adjustable divider is disengaged from the bus bar assembly.

13. The refrigerator appliance of claim 1, wherein the bus bar assembly comprises:

a plurality of positive strip terminals that extend along the lateral direction parallel to the negative strip terminal, wherein each of the plurality of positive strip terminals are electrically coupled to only a portion of the light source.

14. The refrigerator appliance of claim 1, wherein the adjustable divider comprises:

one or more spring pin connectors configured to electrically connect the light source to the bus bar assembly.

15. The refrigerator appliance of claim 1, wherein the power supply assembly comprises:

a looped harness extending between a fixed power supply point on the cabinet and an electrical contact of the adjustable divider.

16. The refrigerator appliance of claim 1, wherein the storage bin is positioned within a freezer chamber of the refrigerator appliance.

17. A drawer assembly for an appliance, the appliance comprising a cabinet defining a chamber, the drawer assembly comprising:

a storage bin positioned within the chamber;

an adjustable divider positioned within the storage bin;

a light source mounted on the adjustable divider; and a bus bar assembly comprising a negative strip terminal that extends along a lateral direction parallel to a plurality of positive strip terminals, the negative strip terminal being electrically connected to the light source as the adjustable divider slides within the storage bin, and wherein each of the plurality of positive strip terminals are electrically coupled to only a portion of the light source.

18. The drawer assembly of claim 17, wherein the adjustable divider comprises:

one or more spring pin connectors configured to electrically connect the light source to the bus bar assembly.

* * * * *